US008427294B2

(12) United States Patent
Cheung

(10) Patent No.: US 8,427,294 B2
(45) Date of Patent: Apr. 23, 2013

(54) SEAT BUCKLE CONFIGURED FOR SECURITY AND SAFETY AND ASSOCIATED METHODS

(75) Inventor: Kwu-Wing W. Cheung, Shoreline, WA (US)

(73) Assignee: The Boeing Company, Chicago, IL (US)

( * ) Notice: Subject to any disclaimer, the term of this patent is extended or adjusted under 35 U.S.C. 154(b) by 304 days.

(21) Appl. No.: 12/059,646

(22) Filed: Mar. 31, 2008

(65) Prior Publication Data

US 2009/0243892 A1 Oct. 1, 2009

(51) Int. Cl.
*B60Q 1/00* (2006.01)

(52) U.S. Cl.
USPC ..... 340/457.1; 340/686.4; 340/693.5

(58) Field of Classification Search ..... 340/457, 340/457.1, 438; 180/268, 269
See application file for complete search history.

(56) References Cited

U.S. PATENT DOCUMENTS 4,849,733 A * 7/1989 Conigliaro et al. ..... 340/457.1
5,839,174 A * 11/1998 Chamings et al. ..... 24/633
5,877,707 A 3/1999 Kowalik
5,984,350 A * 11/1999 Hagan et al. ..... 280/735
6,002,325 A 12/1999 Conaway
6,199,904 B1 3/2001 Dosdall
6,215,395 B1 * 4/2001 Slaughter et al. ..... 340/457.1
6,448,907 B1 9/2002 Naclerio
6,750,764 B1 6/2004 Henninger
6,977,582 B2 12/2005 Ota et al.
7,116,220 B2 10/2006 Almaraz et al.
7,119,671 B2 * 10/2006 Frank et al. ..... 340/457.1
7,209,033 B2 4/2007 Hofbeck et al.
7,466,221 B1 * 12/2008 Lehr ..... 340/457.1
7,642,907 B2 * 1/2010 Tang et al. ..... 340/457.1
7,646,907 B2 * 1/2010 Mashitani et al. ..... 382/154
7,765,652 B2 * 8/2010 Nakamuru et al. ..... 24/633
2004/0140890 A1 * 7/2004 Hartmann et al. ..... 340/457.1
2005/0061568 A1 * 3/2005 Schondorf et al. ..... 180/268
2007/0061847 A1 3/2007 Callahan et al.

* cited by examiner

*Primary Examiner* — George Bugg
*Assistant Examiner* — Edny Labbees
(74) *Attorney, Agent, or Firm* — Armstrong Teasdale LLP

(57) ABSTRACT

A system is described for determining if two seat buckles are attached. The system includes seat belt portions and corresponding seat buckle members. The system also includes a sensing element located within a first seat buckle member and configured to output signals corresponding to one or both of attachment and non-attachment between the seat buckle members. A transmitter located within the first seat buckle member is configured to receive the signals from the sensing element. The transmitter transmits unique identification information, corresponding with a location of the seat belt, and data corresponding to the signals received from the sensing element. A display unit is configured to receive the unique identification information and data from the transmitter and provide a display indicative of an attachment status between the seat buckle members.

21 Claims, 11 Drawing Sheets

450

SEAT BUCKLE CONFIGURED FOR SECURITY AND SAFETY AND ASSOCIATED METHODS

BACKGROUND OF THE INVENTION

The field of the invention relates generally to safety in the operation of passenger vehicles, such as aircraft, and more specifically, to methods and systems associated with seat buckle safety and security.

Airline safety and security procedures are important to ensure the safety and security for passengers using air travel. In one aircraft application, flight attendants have to walk down the aisle and perform a visual inspection of each passenger's seat belt to ensure that their seat belt is engaged (e.g., the seat buckle members are engaged). However, if passengers have clothing or other objects that cover the seat buckle, extra effort will be needed, such as asking for removal of the material, or another time consuming activity. It is possible that a flight attendant will simply assume that seat buckles that are not visible (e.g., under a blanket) are properly engaged.

BRIEF DESCRIPTION OF THE INVENTION

In one aspect, a system for determining if a first portion of a seat belt is attached to a second portion of a seat belt is provided. The system includes a first seat belt portion comprising a first seat buckle member, a second seat belt portion comprising a second seat buckle member, where the second seat buckle member is configured to engage the first seat buckle member in a releasable attachment. The system also includes a sensing element located within the first seat buckle member and configured to output signals corresponding to one or both of attachment and non-attachment between the first seat buckle member and the second seat buckle member and a transmitter located within the first seat buckle member and configured to receive the signals from the sensing element. The transmitter is configured to transmit unique identification information and data corresponding to the signals received from the sensing element where the unique identification information corresponds with the location of the seat belt. The system also includes a display unit configured to receive the unique identification information and data from the transmitter. The display unit is further configured to provide a display indicative of an attachment status between the first seat buckle member and the second seat buckle member.

In another aspect, a seat belt buckle is provided that includes a first seat buckle member and a second seat buckle member that is configured to engage the first seat buckle member in a releasable attachment. The seat belt buckle also includes a sensing element and a transmitter. The sensing element is located within the first seat buckle member and is configured to output signals corresponding to one or both of attachment and non-attachment between the first seat buckle member and the second seat buckle member. The transmitter is located within the first seat buckle member and is configured to receive the signals from the sensing element. The transmitter is further configured to transmit unique identification information and data corresponding to the signals received from the sensing element, where the unique identification information corresponds with a location of the seat belt buckle.

In still another aspect, a method for monitoring an engagement between a first seat buckle member and a second seat buckle member is provided. The method includes receiving a transmission from the first seat buckle member, the transmission triggered by the mechanical action of one or both of the engaging and disengaging between the first seat buckle member and the second seat buckle member, and operating an indicator based on the received transmissions, the indicator operable to indicate a status of engagement between the first seat buckle member and the second seat buckle member.

DETAILED DESCRIPTION OF THE INVENTION

The various embodiments described herein relate to a seat belt system that either incorporates an energy harvesting sensor/transmitter unit within the seat buckle, transmits an indication of whether the seat buckle is attached, or both. The outward appearance of the seat buckle resembles currently utilized seat buckles, and from a mechanical perspective operates similarly to the currently utilized seat buckles. As will be explained, the inside of the seat buckle houses a self-powered transmitter, along with one or more mechanisms that are operable to convert energy from the engaging and disengaging action performed by a passenger to activate the transmitter. Energy may be harvested from other sources as are also described below, for generation of transmitter power.

In the described embodiments, a receiver receives the signals from the transmitter(s), and causes a type of display to display a seat buckle status (e.g., buckled/unbuckled). Certain embodiments include a display near the individual seat that corresponds to the transmitter. However, this system can be configured to be centrally monitored, for example, at a display panel mounted at a flight attendant area.

In another feature relating to operation of the seat buckles, the receiving side of the buckle is configured with magnets, to which the opposite side of the buckle is attracted, thereby enhancing the ease of engagement between the two. In the specific embodiment described further below, two tiny rare earth magnets are installed at the entrance of the receiving side of the seat buckle. These magnets tend to guide the mating part of the buckle to enter the receiving buckle.

Figure 1:
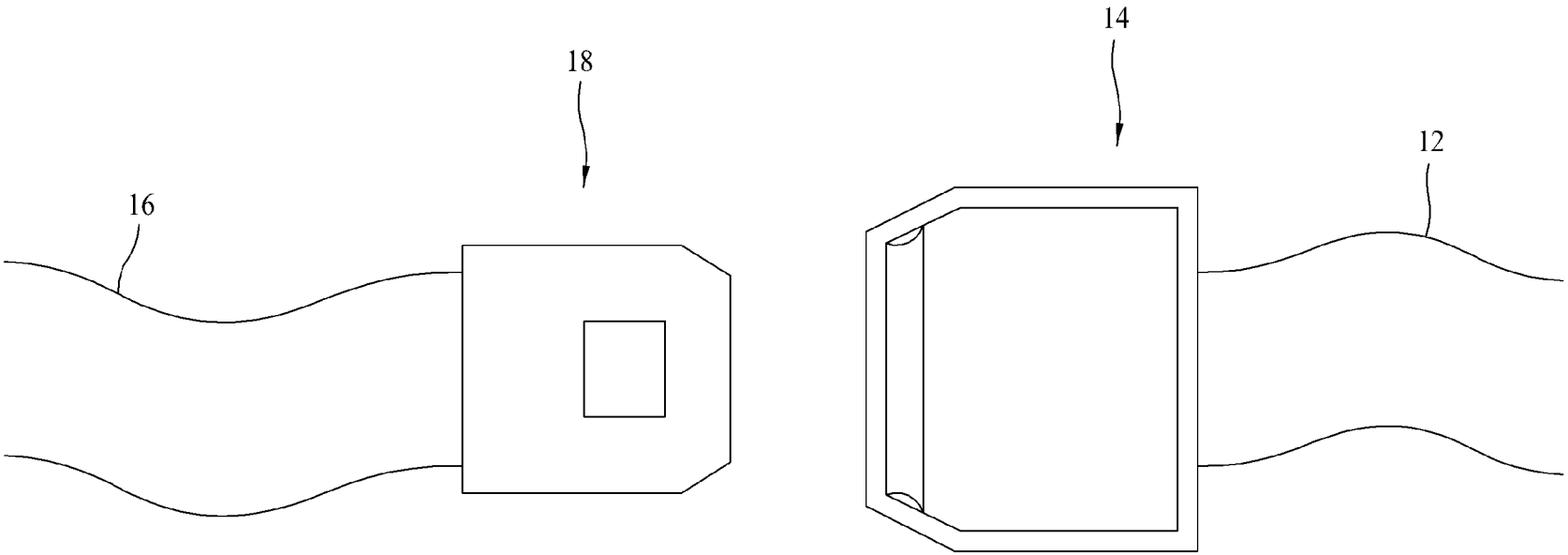
FIG. 1 is an illustration of a typical seat belt system.

Now referring to the figures, FIG. 1 is an illustration of a seat belt system 10. Seat belt system 10 includes a first seat belt portion 12 attached to a first seat buckle member 14 and a second seat belt portion 16 attached to a second seat buckle member 18. As is well known in the art the second seat buckle member 18 is configured to engage the first seat buckle member 14 in a releasable attachment. A system such as seat belt system 10 is common in many if not all passenger aircraft. Similar systems are utilized in automobiles, amusement rides, and numerous other applications.

Figure 2:
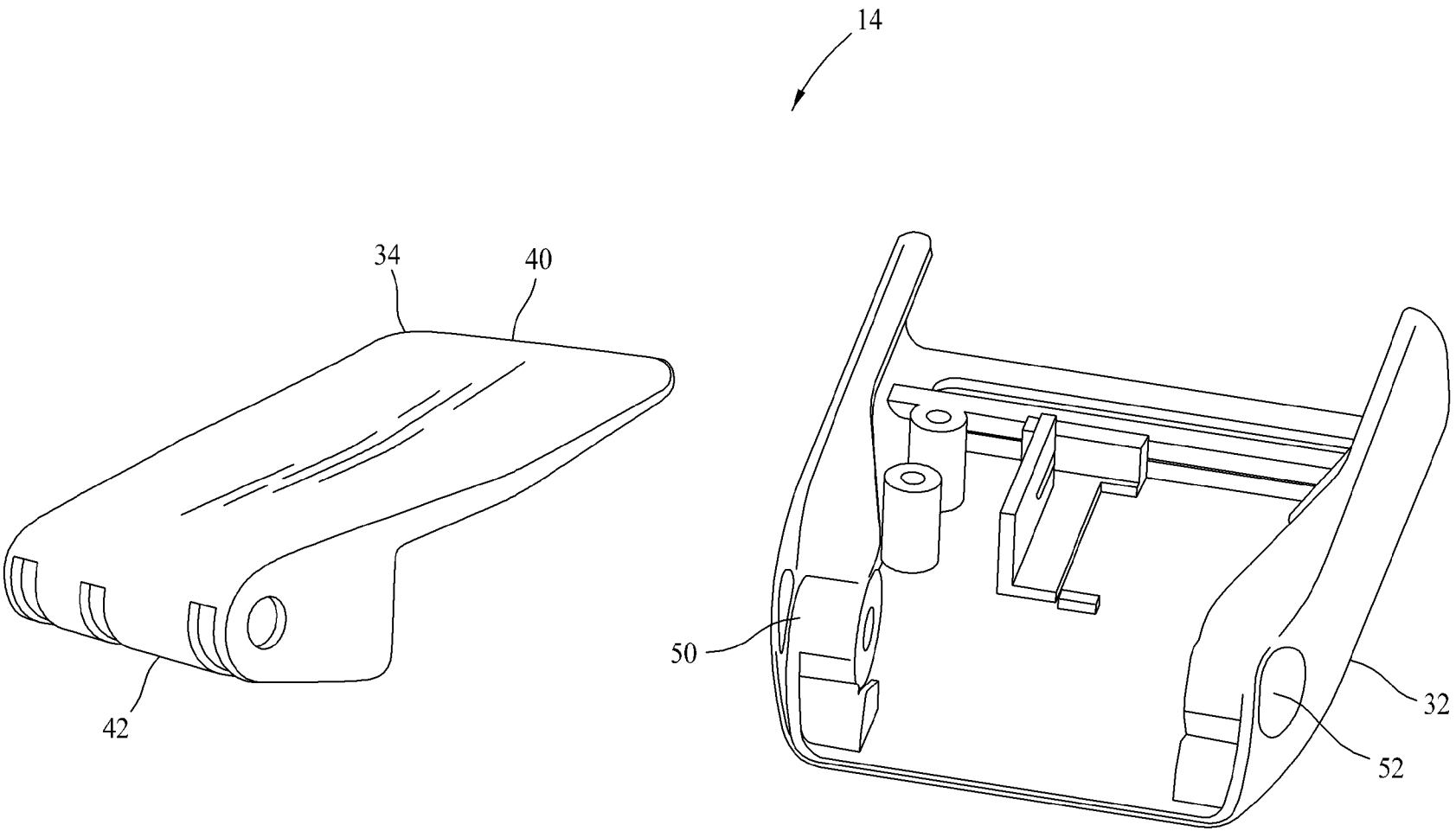
FIG. 2 is an exploded view diagram of one member of a seat belt buckle.

FIG. 2 is an exploded view diagram of first seat buckle member 14 from the seat belt system 10 of FIG. 1. As illustrated, first seat buckle member 14 includes a base member 32 and a pivoting member 34 as well as other mechanical components that are not shown in FIG. 2. When assembled, a user will generally engage a handle end 40 of the pivoting member 34, pull on the handle end 40 causing it to pivot with respect to base member 32 as a pivoting end 42 of the pivoting member 34 is rotatably attached to two retaining members 50 and 52 of the base member 32. Such an action is generally used to release the second seat buckle member 18 of FIG. 1 from an engagement with the first seat buckle member 14. Such an action may also be utilized when a user is attempting to engage the second seat buckle member 18 with the first seat buckle member 14.

Many other configurations for the seat buckle members are possible. In regard to the current disclosure, embodiments are described below in which various components are deployed within a seat buckle member such as first seat buckle member 14. Certain embodiments may include one or more actuating components that are deployed on a seat buckle member such as second seat buckle member 18. While many of these components are described with respect to an installation within a base member of the seat belt buckle, it is to be understood that the described examples are only example configurations, and that other configurations are possible within the spirit and scope of the current disclosure. In one non-limiting example, a portion of these components may be mounted or attached to the pivoting member of the seat buckle member. The described embodiments may also be incorporated in the various seat belt configurations that incorporate a push button mechanism to release the second seat buckle member from the first seat buckle member. Generally, the components are operable to send identification information and data to a display unit for the purpose of illustrating a lock or unlock status for the seat belt, based on an engagement (or non-engagement) between the seat buckle members.

Figure 3A:
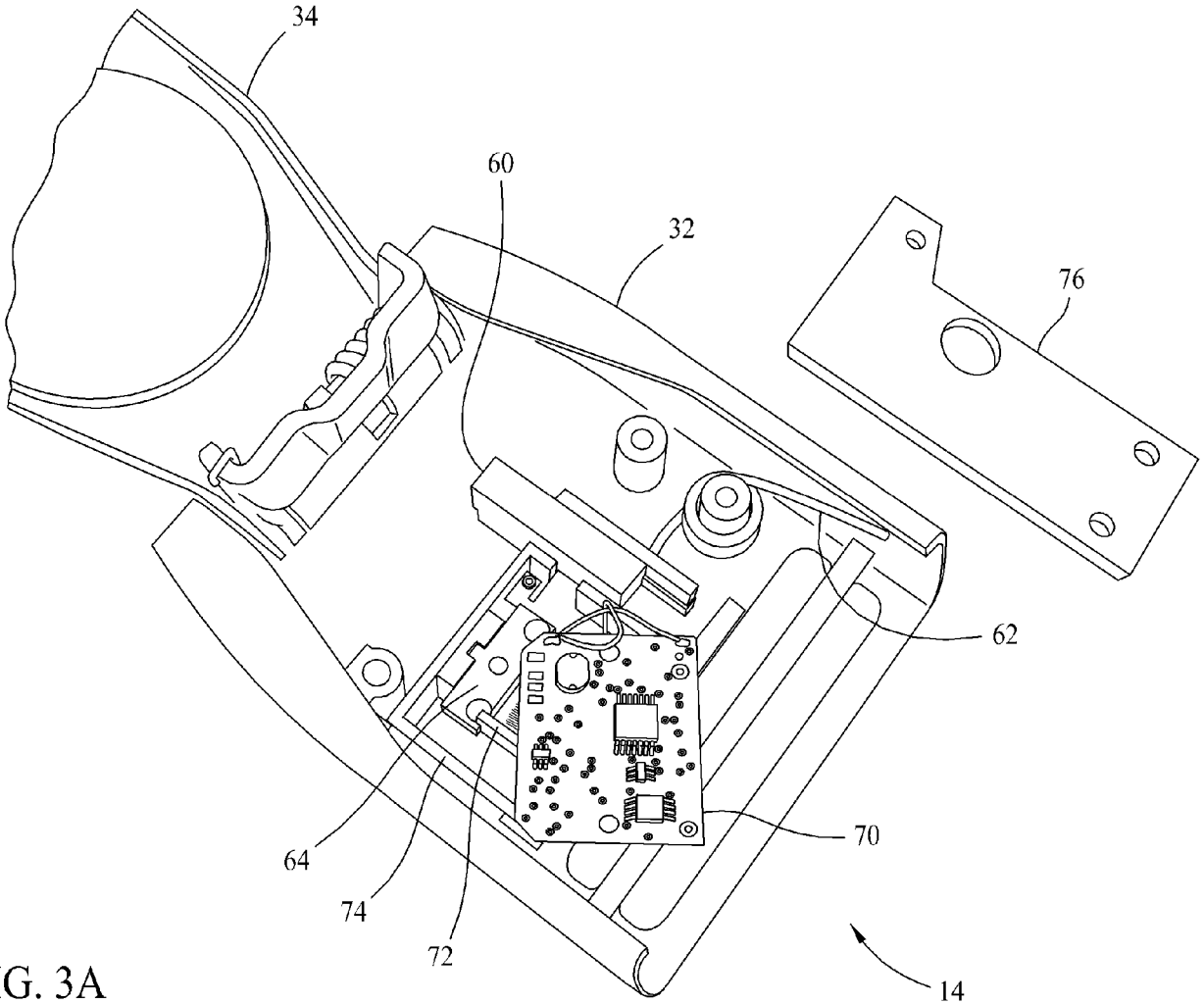
FIGS. 3A and 3B are diagrams of the seat belt system of FIG. 2 including an assembly within the first seat belt buckle member for determining a state of engagement between the first seat buckle member and a second seat buckle member.
Figure 3B:
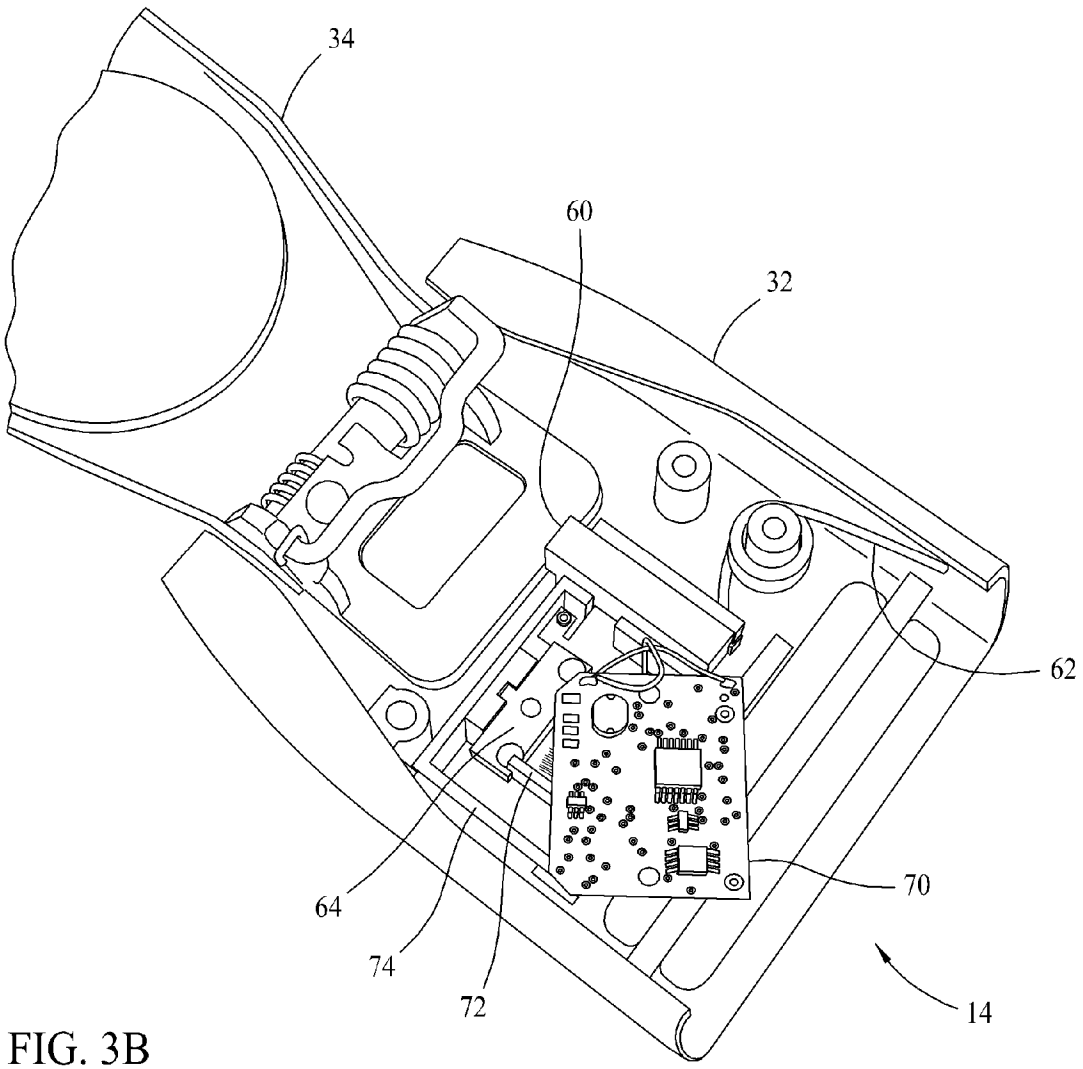

FIGS. 3A and 3B are a detailed view of first seat belt buckle member 14 showing the interconnection between base member 32 and pivoting member 34 as well as showing an inserted position of second seat buckle member 18 within first seat belt buckle member 14. As shown in FIG. 3 B, upon insertion into the first seat buckle member 14, the second seat buckle member 18 is adjacent a triggering device 60. As described in multiple embodiments described herein, the action or operation of the second seat buckle member 18 with respect to triggering device 60 provides a triggering input to a combined energy harvesting/storage device and sensor/transmitter assembly 64. In the particular illustrated by FIGS. 3A and 3B, as the second seat belt member 18 is inserted, it changes a position of triggering device 60, which causes a compression of spring 62 that is subsequently sensed by combined energy harvesting/storage device and sensor/transmitter assembly 64. This assembly 64 includes, for example, a circuit board 70, a coil of wire 72, and housing 74. As is illustrated by FIG. 3, such an assembly is sized to fit within the base member 32 of first seat belt buckle member 14.

A cover plate 76 is generally included and attached to base member 32 after installation of assembly 64 such that the assembly 64 is not exposed to a user during normal operation of the seat belt buckle assembly (e.g., first seat belt buckle member 14 and second seat buckle member 18). The illustration of FIG. 3 is included herewith to demonstrate a construction of the base member 32, and installation of one particular energy harvesting/storage device and sensor/transmitter assembly 64. Particular embodiments for such assemblies are described in operational detail in the following paragraphs with respect to several of the figures.

Figure 4:
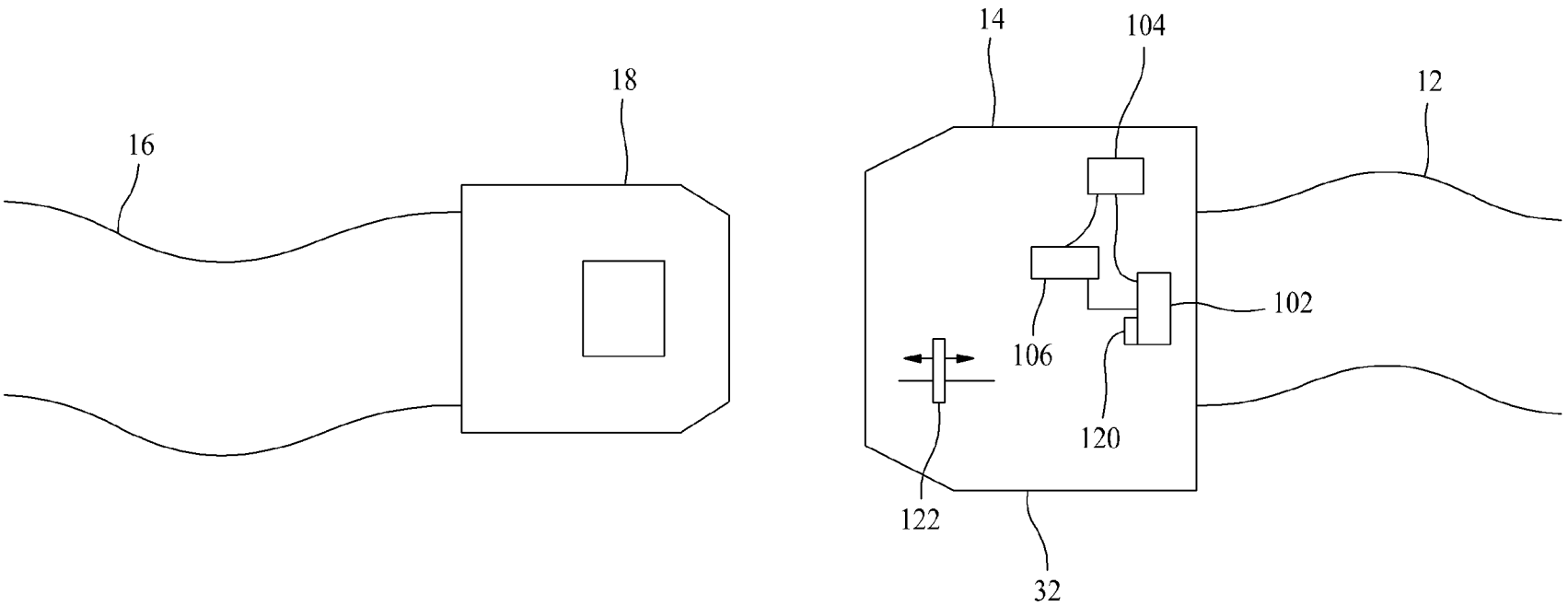
FIG. 4 is a schematic view of a seat buckle assembly for determining a state of engagement between a first seat buckle member and a second seat buckle member.

FIG. 4 is a schematic view of a seat buckle assembly 100. In addition to seat buckle members 14 and 18, seat buckle 100 includes a wireless sensor/transmitter 102 that is powered by a photovoltaic cell 104 which also provides a charge to an energy storage device 106, such as a battery or capacitor. When ambient light is not available, or is insufficient, the energy storage device 106 provides electrical power to sensor/transmitter 102. The wireless sensor/transmitter 102 is installed in base member 32. One or more sensing elements 120, for example, a magnetic reed switch or a mechanical micro-switch, are utilized to sense when the second seat buckle member 18 is in its normally installed position which is utilized as an input to the sensor/transmitter 102. The sensing element, in the illustrated embodiment, is activated by a magnetic device 122 that is slidably mounted or attached within the first seat belt buckle member 14. Upon insertion of the second seat buckle member 18, an engagement between the magnetic device 122 and member 18 occurs which causes magnetic device 122 to move in relation to the sensing element 120. When the member 18 moves the magnetic device 122 to a position proximate sensing element 120, the sensing element 120 changes state, activating the sensor/transmitter 102. Mechanically, movement of the magnetic device 122 is accomplished similarly to the movement of the triggering device 60 illustrated in FIG. 3.

In operation, sensor 120 is operable to alert the low power, wireless sensor/transmitter 102 of the installation state of the second seat buckle member 18 (e.g., if the second seat buckle member 18 is inserted into and engaged with first seat buckle member 14). In one embodiment, the sensor/transmitter 102 is programmed to transmit a unique identification code and a state (engaged/disengaged) of the seat buckles whenever the sensed condition changes. The sensor/transmitter 102 may also be programmed to wirelessly transmit it's unique identification code on a periodic basis, whether the state of the sensor 120 has changed or not, to provide a "sign of life" signal.

The wireless sensor/transmitter 102 is usually powered by the ambient light impinging the photovoltaic cell 104. The cell 104 is also utilized to maintain a charge on a battery and/or a capacitor (energy storage device 106). The battery and/or super-capacitor provide the energy needed to power the wireless sensor/transmitter 102 when the ambient light is not sufficient.

In operation, the magnetic material 122 is pushed by the second seat buckle member 18 such that it is adjacent to sensor 120 when the second seat buckle member 18 is engaged with the first seat buckle member 14. When the second seat buckle member 18 is disengaged from the first seat buckle member 14, the magnetic material 122 moves away from the sensor 120 and the sensor/transmitter 102. In one embodiment, sensor 120 is a magnetic reed switch within the sensor transmitter 102 that senses that the magnetic material 122 is not nearby. When the magnetic material 112 is no longer proximate sensor 120, the reed switch therein changes state, causing the sensor/transmitter 102 to transmit its identification number, and other data indicating that the sensor 120 does not sense the magnetic material 122. Likewise, when the second seat buckle member 18 is engaged with the first seat buckle member 14, the sensor 120 senses the presence of the magnetic material 122 (the switch or sensing element again changes state) and the sensor/transmitter 102 transmits its identification number, and other data indicating that the second seat buckle member 18 and the first seat buckle member 14 are again engaged.

Figure 5:
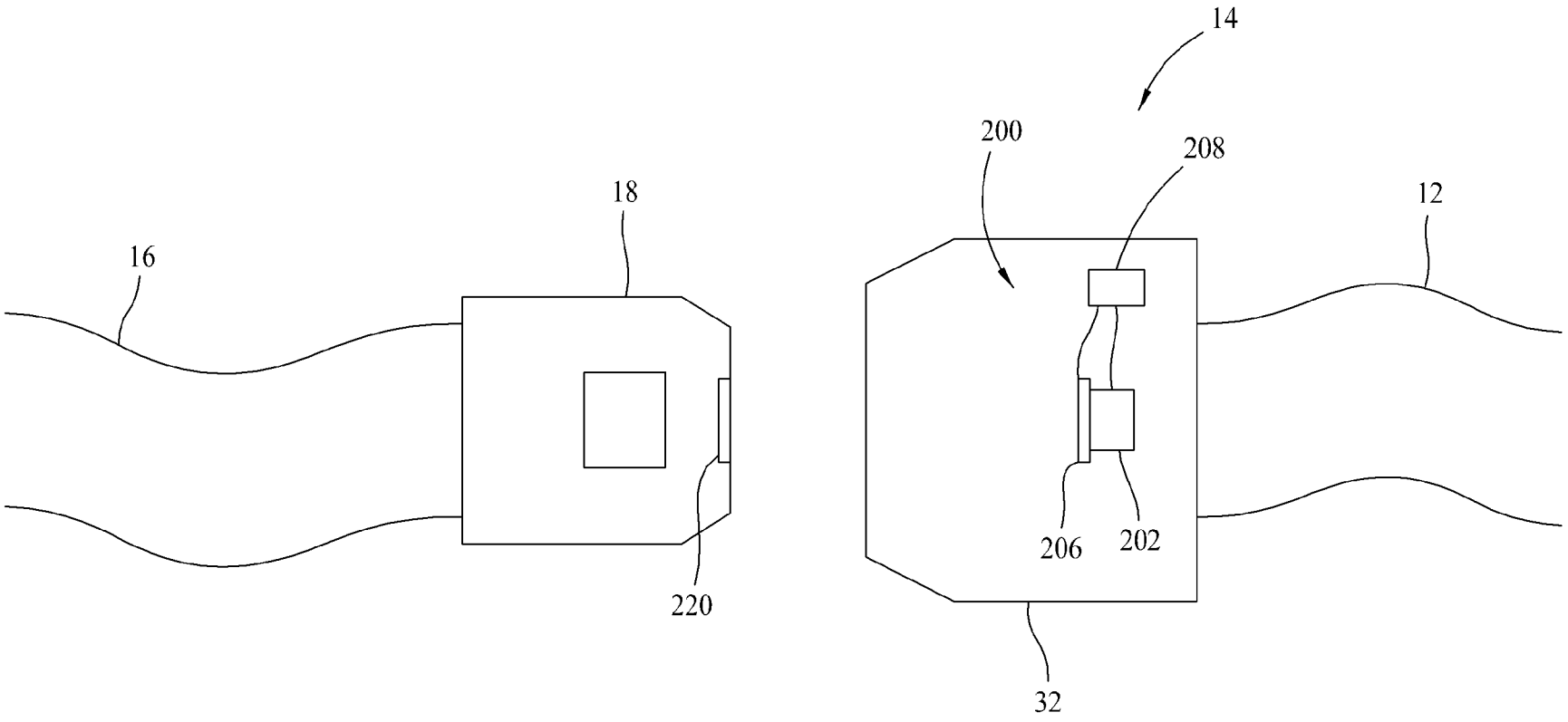
FIG. 5 is a schematic view of an alternative seat buckle assembly for determining a state of engagement between the first seat buckle member and the second seat buckle member.

FIG. 5 is a schematic view of an alternative sensor assembly 200 for determining a state of engagement between the first seat buckle member 14 and the second seat buckle member 18. Sensor assembly 200 is a mechanically-powered wireless sensor and transmitter. Specifically, a mechanically-powered wireless sensor/transmitter 202 is installed within the first seat buckle assembly 14 such that the mechanical work involved in the engagement between the first seat buckle member 14 and the second seat buckle member 18 may be converted into electrical power using a mechanical energy harvester 206. A portion of this power may be stored in an energy storage device 208 to power any transmissions that may need to occur when the mechanical energy is not present, as further described below. Specifically, the mechanical energy harvester 206 as it is compressed and decompressed against the second seat buckle member 18. This electrical power is used to transmit, over a wireless channel, an "engaged" or a "disengaged" signal, along with a unique identification number associated with the individual sensor/transmitter 202.

In one embodiment, the mechanical energy harvester 206 of door assembly 200 may include a piezoelectric device that is caused to deflect or vibrate by the mechanical work present in the above described engagement and disengagement, thus producing an electrical charge in the piezoelectric materials. In another embodiment, the mechanical energy harvester 206 includes an electro-dynamic device including a coil of wire. A magnetic field, caused by a magnetic device 220 present on the second seat buckle member 18 is caused to move relative to the coil of wire to produce an electric current in the coil of wire. In one specific embodiment, the polarity of the generated electric charge (or polarity of first half-cycle of AC generated power) may be sensed by the sensor/transmitter 202 to detect whether the seat buckle is going through an "engaging" or "disengaging" event.

Each wireless sensor/transmitter 202 generally includes one or more sensor(s), a microprocessor, and a radio transmitter. Additionally, each sensor/transmitter 202 includes a small energy storage device 208, as mentioned above, such as a battery and/or a capacitor, in addition to the energy harvesting device 206. In various embodiments, the energy harvesting 206 device converts ambient energy of one form into electricity to power the sensor/transmitter 202. As a result, the sensor/transmitter 202 is completely wireless and powered either by the energy storage device 208 and/or by converting ambient energy in its surrounding environment. These energy generation and storage capabilities make the sensor assembly 200 easy to install, particularly in a retrofit or after-market scenario, since no power or data wires need to be routed to the sensor assembly 200.

The sensor/transmitters 202 are, in one embodiment, configured to sample the state of engagement between the first seat buckle member 14 and the second seat buckle member 18 on a schedule (e.g. sample state of engagement every second). The sensor/transmitter 202 may also be triggered by an external event, such as the act of engaging or disengaging the first seat buckle member 14 and the second seat buckle member 18. In another example, the sensor/transmitter 202 is configured to conform to a periodic schedule whereby it samples the state of engagement every second and wirelessly reports whenever that state has changed, but at least every hour to provide a "sign of life" signal. As another example, the sensor portion of sensor/transmitter 202 is a switch that only awakens the microprocessor of sensor/transmitter 202 when it changes from an open to closed circuit, or visa versa. It is well known in the art of microprocessors to support such a polling or wake-on-demand function.

Figure 6:
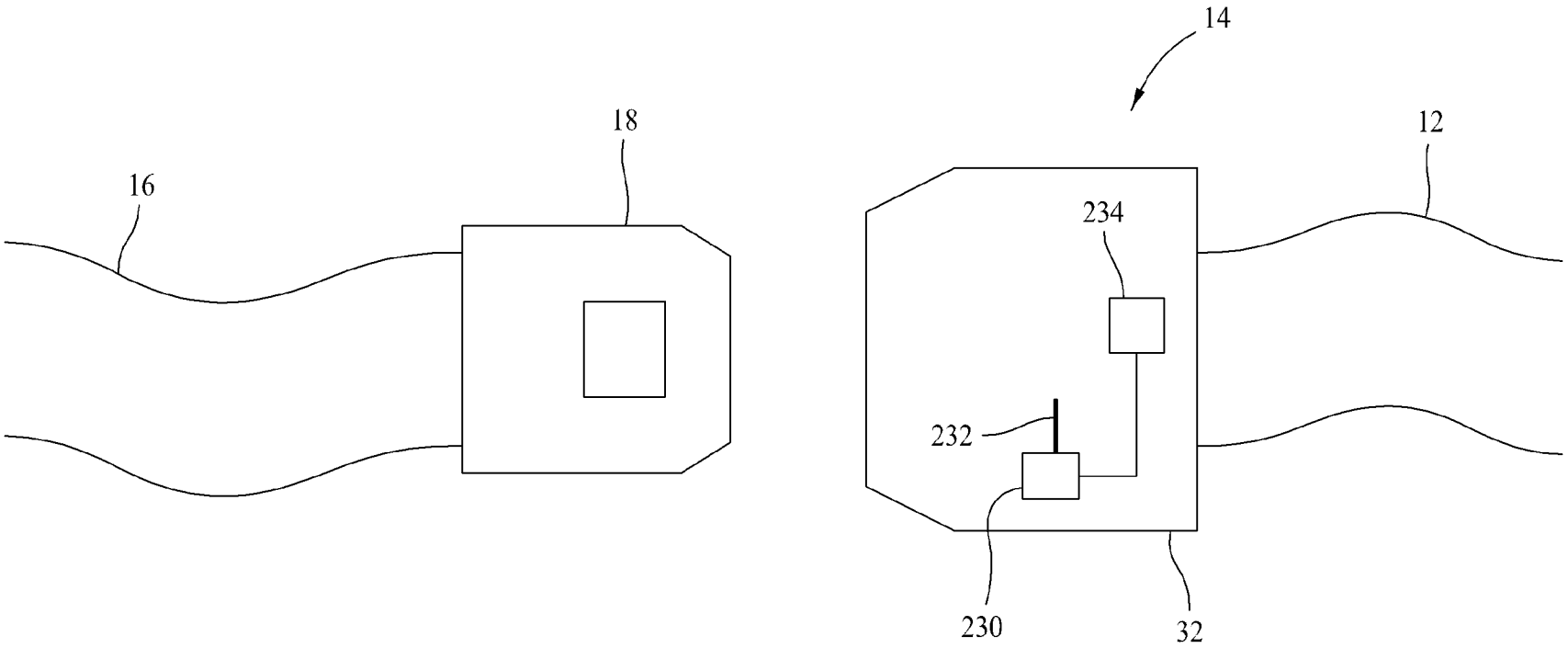
FIG. 6 is a schematic view of another alternative seat buckle assembly for determining a state of engagement between the first seat buckle member and the second seat buckle member.

In still another example, illustrated in FIG. 6, a sensor/transmitter 230 is coupled to a spring-loaded lever 232 that changes state when the first seat buckle member 14 engages, or disengages, the second seat buckle member 18. This mechanical spring release action of spring-loaded lever 232 is converted to electricity and activates the sensor/transmitter 230 to transmit a corresponding message that indicates the state of the engagement between the first seat buckle member 14 and the second seat buckle member 18. In this example, the sensor transmitter 230 is powered by the change of state in the object it is intended to sense. More specifically, physical contact between the second seat buckle member 18 and the spring-loaded lever 232 that causes the lever to move to a point where a signal changes state is a source of power for the sensor/transmitter 230. The described arrangement also serves to harvest the mechanical energy generated as described above to provide a charge to an energy storage device 234. In an alternative embodiment, the lever 232 assembly is replaced by a micro-switch configured to engage the second seat buckle 18 as it is inserted into the first seat buckle 14 or a magnetic reed relay that changes state as it comes into proximity (or proximity is removed) with the second seat buckle 18.

Other packaging concepts include alternative energy harvesting devices connected to a sensor and transmitter combination, which may consist of, for example, a vibration harvesting device, such as a cantilevered piezoelectric beam, exposed to airplane or operational vibration, or a thermoelectric device exposed to a thermal gradient, such as the heat radiated by a person wearing a seat belt unit.

No matter what physical configuration is incorporated, each of the above described sensor/transmitters, when deployed as part of a system is configured with a unique identification number that is included in its transmitted data packet to allow the system to distinguish between sensor/transmitters and associated sensor locations. Through the use of energy harvesting, sensor/transmitters do not require any airplane wiring thereby making them light weight and easy to install. Further, no airplane power or data wiring is required for their normal operation and such devices are virtually maintenance free.

Figure 7:
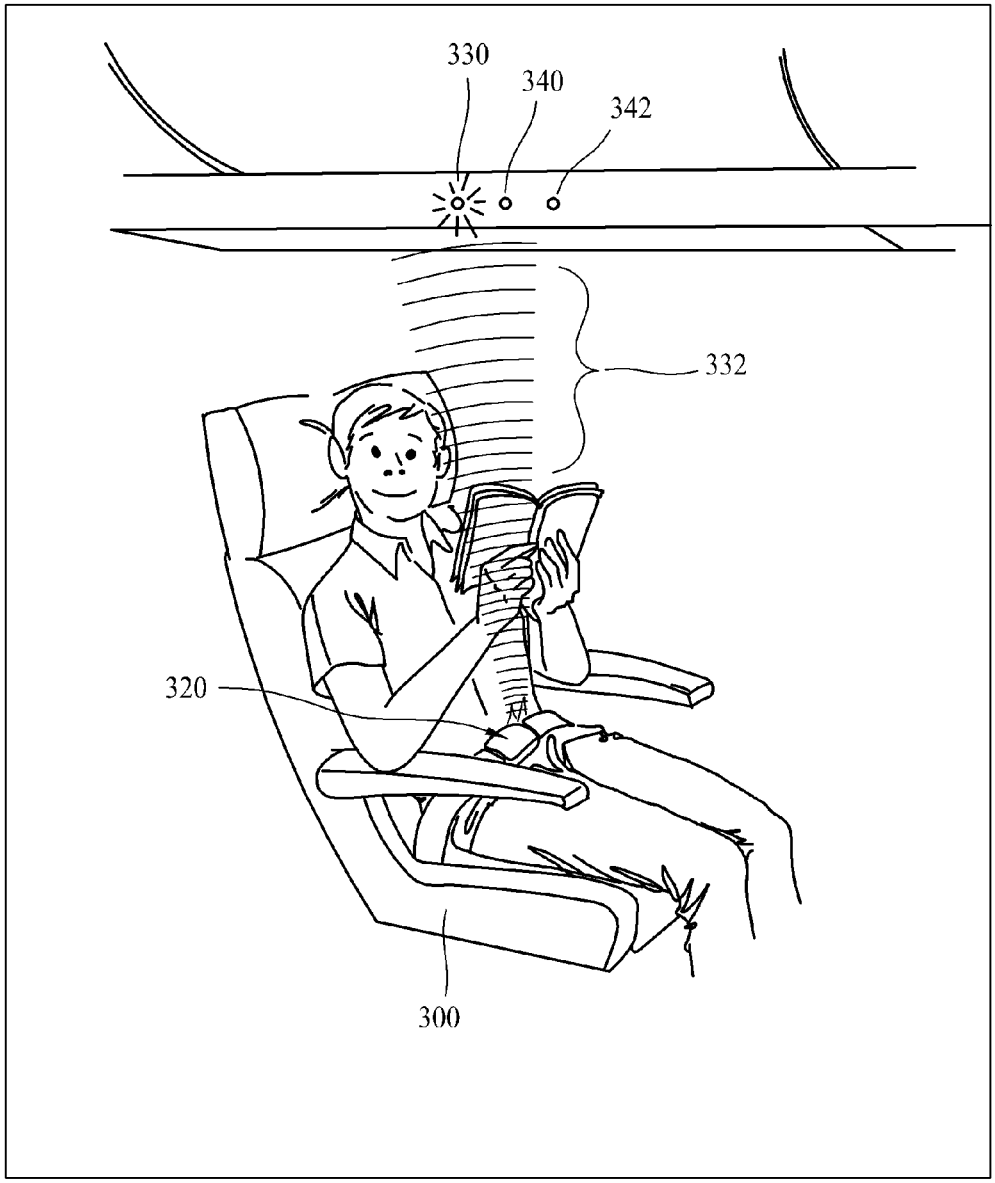
FIG. 7 is an illustration of an aircraft seat and seat belt assembly that incorporates one of the embodiments described with respect to FIGS. 2-5 as well as an indicator providing a status of an engagement between the first seat buckle member and the second seat buckle member.

FIG. 7 is an illustration of an aircraft seat 300 and seat belt assembly 320 that incorporates one of the embodiments described with respect to FIGS. 2-5 as well as an indicator 330 providing a status of an engagement between the first seat buckle member and the second seat buckle member of seat belt assembly 320. The indicator 330, as illustrated, is located within an area above the seat 300 associated with the seat belt assembly 320. Transmission signals 332 are included in FIG. 6 to illustrate the above described transmitter operation in causing the indicator 330 to display an indication of the engagement status between the members of the seal belt assembly 320. Indicators 340 and 342 are included to illustrate a configuration when multiple seats are included in a row, such as is found in typical aircraft seat configurations.

In one embodiment, indicator 330 is a light emitting device, such as an LED, that illuminates when the first seat buckle member 14 (not shown in FIG. 7) is properly engaged with the second seat buckle member 18 (not shown in FIG. 7) and extinguishes when the first seat buckle member 14 is no longer engaged with the second seat buckle member 18. In an embodiment that might be utilized to reduce the amount of required electrical power, indicator 330 is a light emitting device that extinguishes when the first seat buckle member 14 is properly engaged with the second seat buckle member 18 and illuminates when the first seat buckle member 14 is no longer engaged with the second seat buckle member 18. In still another embodiment, indicator 330 is a light emitting device that illuminates with a first color when the first seat buckle member 14 is properly engaged with the second seat buckle member 18 and illuminates with a second color when the first seat buckle member 14 is no longer engaged with the second seat buckle member 18.

Figure 8:
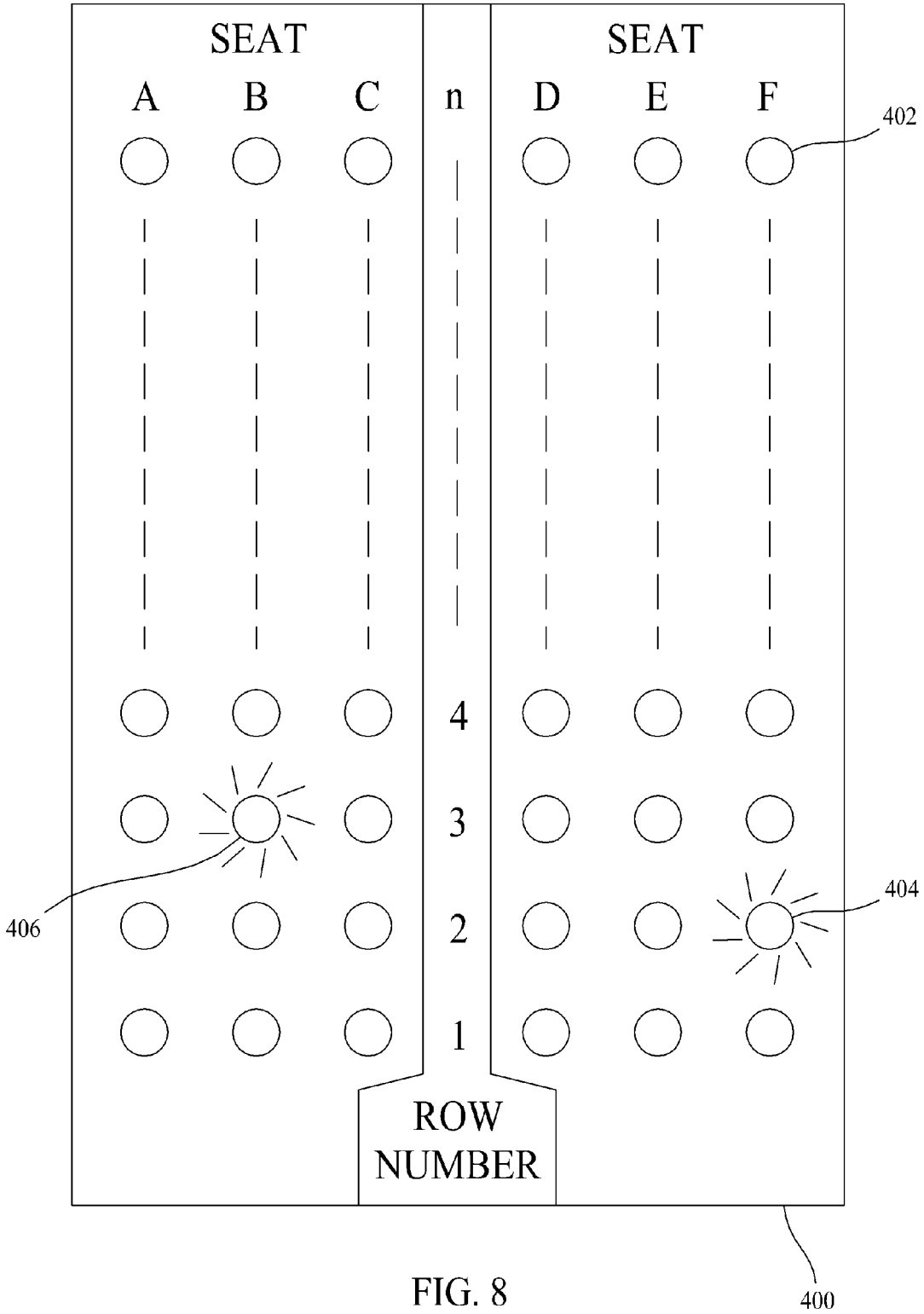
FIG. 8 is an illustration of an indicator panel that provides a status of an engagement between a plurality of first seat buckle members and the corresponding plurality of second seat buckle members.

FIG. 8 is an illustration of an indicator panel 400 that may be located within an aircraft, for example, within a galley or other steward/stewardess monitored area. Indicator panel 400 provides a status relating to the engagement between the seat buckle members for all of the seats within an aircraft. In the particular example of FIG. 8, the aircraft is configured with "n" rows of seats, with each row having six seats, respectively denoted as being one of seat "A", "B", "C", "D", "E", and "F", with an indicator 402 for each seat in each row.

As with indicator 330 above, indicators 402 can be provided in several embodiments. For example, indicators 402 are light emitting devices, such as LEDs, that illuminate when the first seat buckle member 14 (not shown in FIG. 8) is properly engaged with the second seat buckle member 18 (not shown in FIG. 8) and extinguish when the first seat buckle member 14 is no longer engaged with the second seat buckle member 18. In an embodiment similar to that described above, indicators 402 are light emitting devices that extinguish when the first seat buckle member 14 is properly engaged with the second seat buckle member 18 and illuminate when the first seat buckle member 14 is no longer engaged with the second seat buckle member 18. In still another embodiment, indicators 402 are light emitting devices that illuminates with a first color when the first seat buckle member 14 is properly engaged with the second seat buckle member 18 and illuminate with a second color when the first seat buckle member 14 is no longer engaged with the second seat buckle member 18. Whichever embodiment is incorporated, FIG. 8 illustrates that two seat belt assemblies are not properly engaged as denoted by indicator 404, corresponding to row 2, seat F, and by indicator 406, corresponding to row 3, seat B, prompting the aircraft flight personnel to make a visual inspection of those seats, for example, before the aircraft is allowed to take off.

Figure 9:
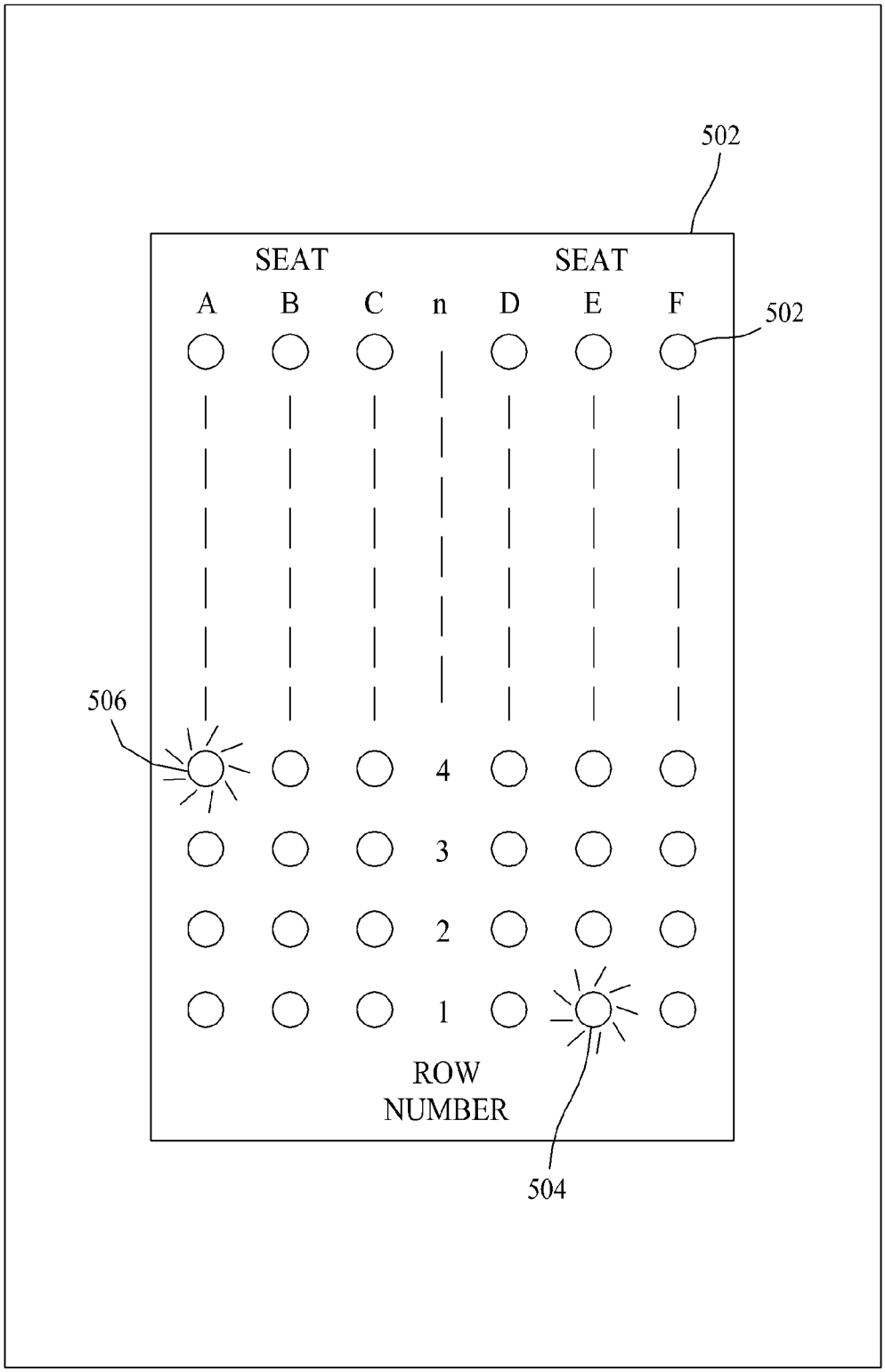
FIG. 9 is a computer screen display that provides the functionality of the indicator panel of FIG. 8.

FIG. 9 is an illustration of a computer display 450 or flight display configured to display an attachment status for a plurality of the seat belts. Instead of the seat belt status information being conveyed via an indicator panel 400 as is illustrated by FIG. 8, the information is presented, in a similar fashion, by a computer or other display within the aircraft. Since computer display does not incorporate LEDS, the indications are provided by display elements 502 that are in a first color when a corresponding first seat buckle member 14 is properly attached with a corresponding second seat buckle member 18 and display elements 502 in a second color when the corresponding first seat buckle member is disengaged from the corresponding second seat buckle member. FIG. 9 also illustrates that two seat belt assemblies are not properly engaged as denoted by indicator 504, corresponding to row 1, seat E, and by indicator 506, corresponding to row 4, seat A, prompting the aircraft flight personnel to make a visual inspection of those seats, for example, before the aircraft is allowed to take off. Such an application might utilize a computer system having stored therein a database of row and seat configurations for individual aircraft from which the display provided by computer display 450 is generated.

Figure 10:
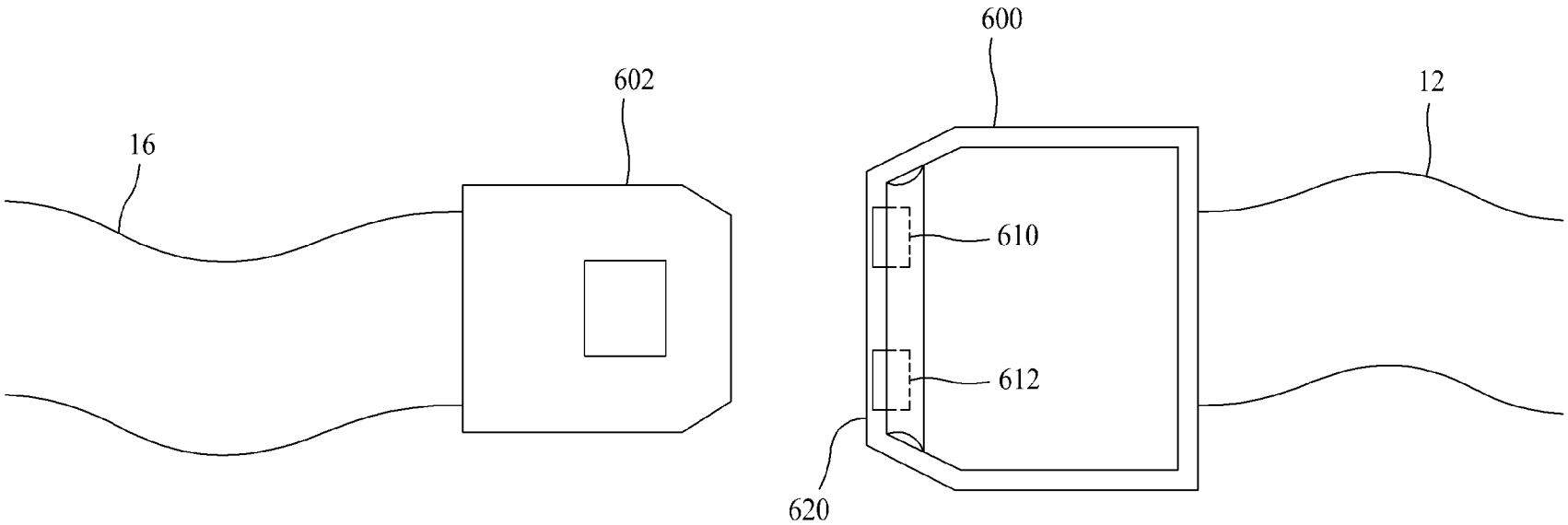
FIG. 10 is a diagram of a first seat buckle member and a second seat buckle member configured for ease in engagement.

FIG. 10 is a diagram of a first seat buckle member 600 and a second seat buckle member 602 configured for ease in engagement. The receiving member (first seat buckle member 600) is configured for ease in engagement due to, in the illustrated embodiment, two rare earth magnets 610, 612 installed at the "entry way" 620 of the first seat buckle member 600. The magnets 610, 612 operate to guide second seat buckle member 602 for entry into the first seat buckle member 600. In other embodiments, the umber and strength of the magnets may be varied. In one specific embodiment, level of magnetic power provided by magnets 610 and 612 is such that it does not affect other magnetic objects within a one inch circumference. With such a configuration, magnets 610 and 612 do not cause issues, such as damaging mechanical watches, erasing audio tapes, or affecting operation of vital medical devices, etc.

While the invention has been described in terms of various specific embodiments, those skilled in the art will recognize that the invention can be practiced with modification within the spirit and scope of the claims.

What is claimed is:

1. A system for determining if a first portion of a seat belt is attached to a second portion of a seat belt, said system comprising:

a first seat belt portion comprising a first seat buckle member comprising a magnet slidably mounted therein;

a second seat belt portion comprising a second seat buckle member, said second seat buckle member configured to engage said first seat buckle member in a releasable attachment, said magnet configured to slide within said first seat buckle member when said second seat buckle member contacts said magnet;

a sensing element located within said first seat buckle member, sliding of said magnet further configured to cause said sensing element to change state as said second seat buckle member becomes properly engaged with said first seat buckle member and cause said sensing element to change state as said second seat buckle member properly disengages from said first seat buckle member, said sensing element configured to output signals upon changing state, the change in state corresponding to one or both of attachment and non-attachment between said first seat buckle member and said second seat buckle member;

a transmitter located within said first seat buckle member and configured to receive the signals from said sensing element, said transmitter further configured to transmit unique identification information and data corresponding to the signals received from said sensing element, the unique identification information corresponding with a location of the seat belt; and a display unit configured to receive the unique identification information and data from said transmitter, said display unit further configured to provide a display indicative of an attachment status between said first seat buckle member and said second seat buckle member.

2. A system according to claim 1 further comprising:

an electrical energy storage device located within said first seat buckle member; and an energy harvesting device located within said first seat buckle member, operable to store harvested energy in said electrical energy storage device, said sensing element and said transmitter configured to use energy from one or both of said energy harvesting device and said electrical energy storage device.

3. A system according to claim 2 wherein said energy harvesting device comprises at least one of:

a mechanical device activated by one or both of attaching said first seat buckle member to said second seat buckle member, and releasing said first seat buckle member from said second seat buckle member;

a photovoltaic device mounted to said first seat buckle member such that said photovoltaic device may be impinged by one or more light sources;

a vibration harvesting device exposed to vibrations experienced by said first seat buckle member; and a thermoelectric device operable when said first seat buckle member is exposed to a thermal gradient.

4. A system according to claim 1 wherein said transmitter is configured to periodically transmit the unique identification information on a periodic basis, as a verification that said system is operable.

5. A system according to claim 1 wherein said sensing element comprises at least one of:

a magnetically operable switch mounted in said first seat buckle member; and a micro-switch mounted in said first seat buckle member that is operated when mechanically engaged by said magnet.

6. A system according to claim 1 further comprising:

an electrical energy storage device located within said first seat buckle member; and an energy harvesting device located within said first seat buckle member, activated by said sensing element, and operable to store harvested energy in said electrical energy storage device, said sensing element and said transmitter configured to use energy from one or both of said energy harvesting device and said electrical energy storage device.

7. A system according to claim 1 wherein said display unit comprises at least one of:

a receiver configured to receive transmissions from said transmitter and an indicator, said receiver coupled to said indicator, said receiver and said indicator located within an area proximate a seat associated with the seat belt, said indicator configured to display an attachment status for a seat belt as received from said receiver;

a receiver configured to receive transmissions from said transmitter, a computer system configured to receive data from said receiver, and a computer display coupled to said computer system, said computer display configured to display an attachment status for at least one seat belt as received from said receiver; and a receiver configured to receive transmissions from said transmitter and an indicator panel, said receiver coupled to said indicator panel, said indicator panel comprising a plurality of indicators configured to display an attachment status for at least one seat belt as received from said receiver.

8. A system according to claim 7 wherein said indicator and said indicator panel comprise one of:

light emitting devices that illuminate when said first seat buckle member is properly attached to said second seat buckle member and extinguish when said first seat buckle member is disengaged from said second seat buckle member;

light emitting devices that extinguish when said first seat buckle member is properly attached to said second seat buckle member and illuminate when said first seat buckle member is disengaged from said second seat buckle member; and light emitting devices that illuminate with a first color when said first seat buckle member is properly attached to said second seat buckle member and illuminate with a second color when said first seat buckle member is disengaged from said second seat buckle member.

9. A system according to claim 7 wherein said computer display comprises display elements in a first color when a corresponding said first seat buckle member is properly attached to a corresponding said second seat buckle member and display elements in a second color when the corresponding said first seat buckle member is disengaged from the corresponding said second seat buckle member.

10. A system according to claim 1 further comprising at least one magnet fixedly mounted at an engaging end of said second seat buckle member, said at least one magnet operable to enhance an alignment between said first seat buckle member and said second seat buckle member for purposes of guiding said second seat belt member into an alignment position with respect to said first seat buckle member such that said second seat belt member may be inserted into said first seat buckle member.

11. A seat belt buckle comprising:

a first seat buckle member comprising a magnet slidably mounted therein;

a second seat buckle member, said second seat buckle member configured to engage said first seat buckle member in a releasable attachment, said magnet configured to slide within said first seat buckle member when said second seat buckle member contacts said magnet;

a sensing element located within said first seat buckle member, sliding of said magnet further configured to cause said sensing element to change state as said second seat buckle member becomes properly engaged with said first seat buckle member and cause said sensing element to change state as said second seat buckle member properly disengages from said first seat buckle member, said sensing element configured to output signals upon changing state, the change in state corresponding to one or both of attachment and non-attachment between said first seat buckle member and said second seat buckle member; and a transmitter located within said first seat buckle member and configured to receive the signals from said sensing element, said transmitter further configured to transmit unique identification information and data corresponding to the signals received from said sensing element, the unique identification information corresponding with a location of the seat belt buckle.

12. A seat belt buckle according to claim 11 wherein said transmitter is configured to periodically transmit the unique identification information on a periodic basis, as a verification that said system is operable.

13. A seat belt buckle according to claim 11 wherein said sensing element comprises at least one of:

a magnetically operable switch mounted in said first seat buckle member; and a micro-switch mounted in said first seat buckle member that is operated when said second seat buckle member is properly engages, or disengages, said first seat buckle member.

14. A seat belt buckle according to claim 11 further comprising:

an electrical energy storage device located within said first seat buckle member; and an energy harvesting device located within said first seat buckle member, operable to harvest energy received at said first seat buckle member and further operable to store at least a portion of the harvested energy in said electrical energy storage device, said sensing element and said transmitter configured to use energy from one or both of said energy harvesting device and said electrical energy storage device.

15. A seat belt buckle according to claim 14 wherein said energy harvesting device comprises at least one of:

a mechanical device activated by one or both of attaching said first seat buckle member to said second seat buckle member, and releasing said first seat buckle member from said second seat buckle member;

a photovoltaic device mounted to said first seat buckle member such that said photovoltaic device may be impinged by one or more light sources;

a vibration harvesting device exposed to vibrations experienced by said first seat buckle member; and a thermoelectric device operable when said first seat buckle member is exposed to a thermal gradient.

16. A seat belt buckle according to claim 11 further comprising at least one magnet fixedly mounted at an engaging end of said second seat buckle member, said at least one magnet operable to enhance an alignment between said first seat buckle member and said second seat buckle member for purposes of guiding said second seat belt member into an alignment position with respect to said first seat buckle member such that said second seat belt member may be inserted into said first seat buckle member.

17. A method for monitoring an engagement between a first seat buckle member and a second seat buckle member, said method comprising:

utilizing at least one slidably mounted magnet within the first seat buckle member to cause a sensing element within the first seat buckle member to change state when the second seat buckle member contacts the magnet and slides the magnet relative to the sensing element;

receiving a transmission from the first seat buckle member, the transmission triggered by the change of state of the sensing element; and operating an indicator based on the received transmissions, the indicator operable to indicate a status of engagement between the first seat buckle member and the second seat buckle member.

18. A method according to claim 17 further comprising utilizing an energy harvesting device located within the first seat buckle member to provide electrical energy to a transmitter associated with the received transmission and to the sensing element.

19. A method according to claim 18 further comprising:

incorporating an energy storage device into the first seat buckle member; and providing a charge to the energy storage device from the energy harvesting device.

20. A method according to claim 19 further comprising:

providing power to the transmitter from the energy storage device when power from the energy harvesting device is not available or insufficient; and periodically transmitting the status of engagement between the first seat buckle member and the second seat buckle member to verify an operational status of the sensing element and the transmitter.

21. A method according to claim 17 wherein receiving a transmission comprises receiving unique identification information within the transmission, the unique identification information corresponding with a location of the seat buckle members.

* * * * *